US011414844B2

(12) United States Patent
Schloss et al.

(10) Patent No.: US 11,414,844 B2
(45) **Date of Patent: *Aug. 16, 2022**

(54) FLOW CONTROL DEVICE

(71) Applicants: Zev Schloss, Atlanta, GA (US); Gilad Perez, Atlanta, GA (US)

(72) Inventors: Zev Schloss, Atlanta, GA (US); Gilad Perez, Atlanta, GA (US)

( * ) Notice: Subject to any disclaimer, the term of this patent is extended or adjusted under 35 U.S.C. 154(b) by 1 day.

This patent is subject to a terminal disclaimer.

(21) Appl. No.: 17/094,925

(22) Filed: Nov. 11, 2020

(65) Prior Publication Data

US 2021/0062479 A1 Mar. 4, 2021

Related U.S. Application Data

(63) Continuation-in-part of application No. 16/027,087, filed on Jul. 3, 2018, now Pat. No. 10,858,811.

(60) Provisional application No. 62/528,410, filed on Jul. 3, 2017.

(51) Int. Cl.

| | |
|---|---|
| ***E03B 7/12*** | (2006.01) |
| ***E03B 7/04*** | (2006.01) |
| ***E03B 7/07*** | (2006.01) |

(52) U.S. Cl.

CPC ..... *E03B 7/12* (2013.01); *E03B 7/04* (2013.01); *E03B 7/075* (2013.01); *E03B 7/071* (2013.01)

(58) Field of Classification Search

CPC ... E03B 7/04; E03B 7/075; E03B 7/12; Y10T 137/1189; Y10T 137/1353; Y10T 137/1963; Y10T 137/1987

See application file for complete search history.

(56) References Cited

U.S. PATENT DOCUMENTS

| | | | |
|---|---|---|---|
| 299,392 | A | 5/1884 | Jay |
| 4,469,118 | A | 9/1984 | Walters |
| 4,638,828 | A | 1/1987 | Barrineau, Sr. et al. |
| 4,657,038 | A | 4/1987 | Lyons |

(Continued)

FOREIGN PATENT DOCUMENTS

| | | |
|---|---|---|
| CN | 205475455 U | 8/2016 |
| KR | 101628601 B1 | 6/2016 |

OTHER PUBLICATIONS http://www.homedepot.com/p/raindrip-Automatic-Container-and-Hanging-Baskets-Kit-R560DP/205466107.

*Primary Examiner* — Matthew W Jellett

(74) *Attorney, Agent, or Firm* — Mark S. Cohen; Pearl Cohen Zedek Latzer Baratz LLP

(57) ABSTRACT

A system for preventing freeze-induced rupture of a supply pipe is provided, comprising remote and internal temperature sensors for determining first and second temperature data, a flow control device for attachment to the supply pipe. The flow control device comprises an upstream inlet configured to be connected to the supply pipe, a downstream outlet configured to be connected to a drainage pipe, at least one valve disposed between the inlet and the outlet and configured to selectively move between a closed position in which liquid is blocked from flowing therethrough and an open position in which flow of liquid is permitted therethrough, and at least one flow control component configured to limit the flow rate of liquid therethrough. The system further comprises a controller configured to control operation of the at least one valve based at least on one of the first temperature data or the second temperature data.

10 Claims, 6 Drawing Sheets

(56) References Cited

U.S. PATENT DOCUMENTS

| | | | | |
|---|---|---|---|---|
| 4,672,990 | A * | 6/1987 | Robillard | E03B 7/12 126/588 |
| 4,852,601 | A | 8/1989 | Chamberlin | |
| 4,883,082 | A | 11/1989 | Pirkle | |
| 5,318,059 | A | 6/1994 | Lyons | |
| 8,402,984 | B1 * | 3/2013 | Ziegenbein | E03B 7/071 137/15.11 |
| 9,719,234 | B1 | 8/2017 | Samvinesh et al. | |
| 2012/0004778 | A1 | 1/2012 | Lai et al. | |

* cited by examiner

FLOW CONTROL DEVICE

CROSS REFERENCE TO RELATED APPLICATIONS

This application is a Continuation-in-Part of U.S. application Ser. No. 16/027,087, filed on Jul. 3, 2018, and claims the benefit of priority to U.S. provisional application Ser. No. 62/528,410 filed Jul. 3, 2017, both of which are incorporated herein by reference in their entireties.

FIELD OF INVENTION

The presently disclosed subject matter relates to flow control devices and methods; more particularly, improved flow control device and methods for using the device to prevent freeze-induced rupture of supply pipes or lines.

BACKGROUND

During cold weather, the temperature can regularly drop below freezing, thereby causing water pipes and lines to rupture as a result of the increased water pressure caused by the expansion of the water or water-based liquid contained within them as it freezes. A common method of preventing burst pipes is to allow water to continually flow through the pipe for three primary reasons: 1) In order to introduce warmer ground water into the plumbing pipes; 2) In order to prolong the process of ice crystals forming in the water thereby delaying the freezing process; and 3) In order to prevent burst pipes as a result of the increase of water pressure from occurring as a result of the water freezing in a closed pipe. However, not only do homeowners forget to open a faucet every time the temperature drops below freezing but frequently they don't know when or how to properly open their faucet prior to temperatures dropping below freezing.

Numerous devices have been developed that automatically detect drops in temperature in order to prevent damage from occurring by burst pipes. There are also devices that have been developed that automatically detect a leak in a system. However, both of these types of devices require constant electricity from the dwelling, are often complicated, expensive to purchase and require professional installation. Furthermore, these systems typically shut-off water to the entire system making use of water within the home impossible. As a result, current devices are impractical for homes without power as well as homes that depend on water usage.

While there have also been devices created to specifically protect an exterior hose bib and as a result water lines in a house that run to an exterior hose bib. However, these devices have a few shortfalls: They do not protect interior hot or cold-water lines (i.e., those that do not run to the exterior). Further, the devices require constant water outflow, even during non-freezing climates, for as long as the hose valve is open.

Accordingly, there remains a need for improved flow control devices and systems having components housed together that allow easy installation and use. This need and other needs are satisfied by the various aspects of the present disclosure.

SUMMARY

In accordance with the purposes of the presently disclosed subject matter, as embodied and broadly described herein, the presently disclosed subject matter, in one aspect, relates to improved flow control devices and systems, and methods for using the same. In various aspects, the disclosed devices systems, and methods can be installed and used by homeowners to control the flow of water in order to prevent ruptured pipes and lines during freezing temperatures.

In another exemplary aspect, the presently disclosed subject matter relates to a system for preventing freeze-induced rupture of a supply pipe, the device comprising: at least one remote temperature sensor configured to determine first temperature data associated with air outside of a dwelling; a flow control device configured to releasably attach to a faucet or spigot of a supply pipe, the device comprising: a valve configured to control a first flow rate of the liquid flowing from an inlet of the supply pipe along a controlled liquid flow path by moving a valve position from a closed position to an open position; a flow control component in fluid communication with the valve, and configured to control a second flow rate of the liquid flowing from the valve; at least one internal temperature sensor configured to determine second temperature data associated with air adjacent to the device or inside the dwelling; a controller communicatively connected to the temperature sensors and configured to control operation of the valve based at least on at least one of the first temperature data and the second temperature data; and a housing configured to contain the flow control device components and further configured to releasably attach to a spigot or spout of a supply pipe; a faucet adapter configured to detachably couple the flow control device to the faucet such that the inlet is placed in fluid communication with a first opening of the faucet adapter.

In another exemplary aspect, the presently disclosed subject matter relates to a flow control device configured to releasably attach to a faucet or spigot of a supply pipe, the device comprising: at least one remote temperature sensor configured to determine first temperature data associated with air outside of a dwelling; a valve configured to control a first flow rate of the liquid flowing from an inlet of the supply pipe along a controlled liquid flow path by moving a valve position from a closed position to an open position; a flow control component in fluid communication with the valve, and configured to control a second flow rate of the liquid flowing from the valve; at least one internal temperature sensor configured to determine second temperature data associated with air adjacent to the device or inside the dwelling; a controller communicatively connected to the temperature sensors and configured to control operation of the valve based at least on at least one of the first temperature data and the second temperature data; and a housing configured to contain the flow control device components and further configured to releasably attach to a spigot or spout of a supply pipe.

In another exemplary aspect, the presently disclosed subject matter relates to a flow control device for preventing freeze-induced rupture of supply pipes, the device comprising: a valve configured to control flow of water or liquid through a valve opening by moving the valve from a closed position to an open position; at least one temperature sensor configured to determine air temperature data outside the device; a flow control component configured to control a flow of water or liquid from the valve opening; a controller configured to communicate with the temperature sensor and to control the valve position; a power source for powering one or more device components; and a housing configured to house device components and further configured to releasably attach to a spigot or spout of a supply pipe.

In another exemplary aspect, the presently disclosed subject matter relates to a flow control device for preventing freeze-induced rupture of supply pipes, the device comprising: a valve configured to control flow of water or liquid through a valve opening by moving the valve from a closed position to an open position; a solenoid configured to control opening and closing of the valve; at least one temperature sensor configured to determine air temperature data outside the device; a flow control orifice, drip emitter or dripper configured to control a flow of water or liquid from the valve opening; a controller configured to communicate with the temperature sensor and to control the valve position; a power source for powering one or more device components; and a housing configured to house device components and further configured to releasably attach to a spigot or spout of a supply pipe.

In further aspects, the presently disclosed subject matter also relates to methods for using the disclosed devices and systems.

Additional aspects of the presently disclosed subject matter will be set forth in part in the description which follows, and in part will be obvious from the description, or can be learned by practice of the presently disclosed subject matter. The advantages of the presently disclosed subject matter will be realized and attained by means of the elements and combinations particularly pointed out in the appended claims. It is to be understood that both the foregoing general description and the following detailed description are exemplary and explanatory only and are not restrictive of the presently disclosed subject matter, for example as claimed.

According to some aspects of the presently disclosed subject matter, there is provided a system for preventing freeze-induced rupture of one or more supply pipes, the system comprising:

at least one remote temperature sensor configured to determine first temperature data associated with air outside of a building;

at least one internal temperature sensor configured to determine second temperature data associated with air adjacent to the flow control device; and a flow control device configured attach to the one or more supply pipes, the flow control device comprising:

a) an inlet disposed at an upstream end of the flow control device, each configured to be connected to at least one of the one or more supply pipes;

b) an outlet disposed at a downstream end of the flow control device and configured to be connected to a drainage pipe;

c) at least one valve disposed between the inlet and the outlet, and being configured to be electronically controlled to selectively move between a closed position in which liquid is blocked from flowing therethrough, and an open position in which flow of liquid is permitted therethrough; and d) at least one flow control component disposed between the inlet and the outlet, and being configured to limit the flow rate of liquid therethrough;

the system further comprising a controller communicatively connected to the at least one remote temperature sensor and the at least one internal temperature sensor, and being configured to control operation of the at least one valve based at least on one of the first temperature data or the second temperature data.

The at least one valve may be disposed upstream of the at least one flow control component.

The flow control device may comprise two inlets, each configured to be connected to at least one of the supply pipes.

The flow control device may comprise two of the valves, each being disposed downstream of one of the inlets.

The flow control device may comprise a separate flow control component associated with each of the valves.

The flow control device may comprise a single flow control component associated with all of the valves.

The controller may be configured to operate the valves such that no more than one is in its open position simultaneously.

The controller may be configured to direct at least one of the valves to assume its respective open position the when at least first temperature data or the second temperature data is below a predetermined threshold.

The controller may be configured to direct at least one of the valves to assume its respective closed position the when at least first temperature data or the second temperature data is above a predetermined threshold.

The system may further comprise one or more flow sensors, the controller being further configured to determine one or more fault conditions based at least on data provided by the one or more flow sensors.

BRIEF DESCRIPTION OF THE DRAWINGS

The accompanying drawings, which are incorporated in and constitute a part of this specification, illustrate several aspects of the presently disclosed subject matter and together with the description, serve to explain the principles of the presently disclosed subject matter.

DETAILED DESCRIPTION

Figure 1:
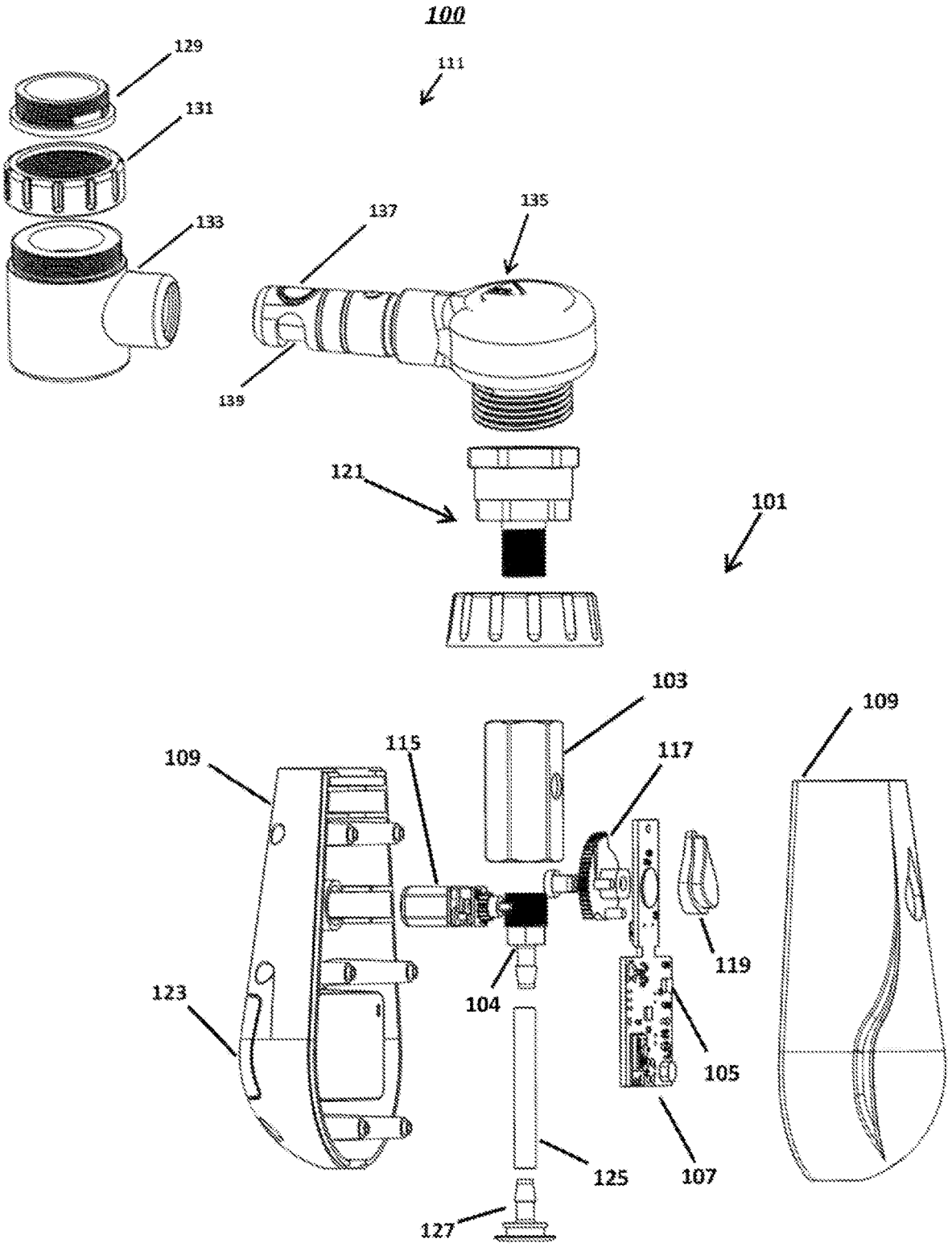
FIG. 1 shows a picture depicting a flow control device in accordance with an exemplary embodiment of the presently disclosed subject matter.

The presently disclosed subject matter can be understood more readily by reference to the following detailed description of the presently disclosed subject matter and the examples included therein.

Before the present articles, systems, devices, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the presently disclosed subject matter, example methods and materials are now described.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

All publications mentioned herein are incorporated herein by reference to disclose and describe the methods and/or materials in connection with which the publications are cited.

It is also to be understood that the terminology used herein is for the purpose of describing particular aspects only and is not intended to be limiting. As used in the specification and in the claims, the term "comprising" can include the aspects "consisting of" and "consisting essentially of" Unless defined otherwise, all technical and scientific terms used herein have the same meaning as commonly understood by one of ordinary skill in the art to which this presently disclosed subject matter belongs. In this specification and in the claims, which follow, reference will be made to a number of terms which shall be defined herein.

As used in the specification and the appended claims, the singular forms "a," "an" and "the" include plural referents unless the context clearly dictates otherwise. Thus, for example, reference to "a valve" includes two or more valves.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Disclosed are the components to be used to manufacture the disclosed devices and articles of the presently disclosed subject matter as well as the materials themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the presently disclosed subject matter. Thus, if there are a variety of additional steps that can be performed it is understood that each of these additional steps can be performed with any specific aspect or combination of aspects of the methods of the presently disclosed subject matter.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

As briefly described above, the present disclosure relates, in various aspects, to devices for control flow of pipes, lines, hoses, and the like. In one aspect, the present disclosure provides a flow control device for preventing freeze-induced rupture of supply pipes. In further aspects, the flow control device is configured to releasably attach to a faucet or spigot of a supply pipe, the device comprising: at least one remote temperature sensor configured to determine first temperature data associated with air outside of a dwelling; a valve configured to control a first flow rate of the liquid flowing from an inlet of the supply pipe along a controlled liquid flow path by moving a valve position from a closed position to an open position; a flow control component in fluid communication with the valve, and configured to control a second flow rate of the liquid flowing from the valve; at least one internal temperature sensor configured to determine second temperature data associated with air adjacent to the device; a controller communicatively connected to the temperature sensors and configured to control operation of the valve based at least on at least one of the first temperature data and the second temperature data; and a housing configured to contain the flow control device components and further configured to releasably attach to a spigot or spout of a supply pipe.

In another aspect, the present disclosure provides a system for preventing freeze-induced rupture of a supply pipe, the device comprising: at least one remote temperature sensor configured to determine first temperature data associated with air outside of a dwelling; a flow control device configured to releasably attach to a faucet or spigot of a supply pipe, the device comprising: a valve configured to control a first flow rate of the liquid flowing from an inlet of the supply pipe along a controlled liquid flow path by moving a valve position from a closed position to an open position; a flow control component in fluid communication with the valve, and configured to control a second flow rate of the liquid flowing from the valve; at least one internal temperature sensor configured to determine second temperature data associated with air adjacent to the device; a controller communicatively connected to the temperature sensors and configured to control operation of the valve based at least on at least one of the first temperature data and the second temperature data; and a housing configured to contain the flow control device components and further configured to releasably attach to a spigot or spout of a supply pipe; a faucet adapter configured to detachably couple the flow control device to the faucet such that the inlet is placed in fluid communication with a first opening of the faucet adapter.

In further aspects, the device may comprise a valve configured to control flow of water or liquid through a valve opening by moving the valve from a closed position to an open position; a solenoid configured to control opening and closing of the valve; at least one temperature sensor configured to determine air temperature data outside the device; a flow control component configured to control a flow of water or liquid from the valve opening; a controller configured to communicate with the temperature sensor and to control the valve position; a power source for powering one or more device components; and a housing configured to house device components and further configured to releasably attach to a spigot or spout of a supply pipe. In further aspects, the spigot or spout may a spigot or spout of a supply fixture, for example, and without limitation, a faucet, hose bib, or the like. In some aspects, the spigot or spout may be an outdoor spigot or spout. In other aspects, the spigot or spout may be an indoor spigot or spout.

In various aspects, the dripper can be configured to allow a predetermined flow of water or liquid through the valve sufficient to prevent water or liquid in the supply pipe from freezing. In yet further aspects, the solenoid valve can be configured to move from the closed position to the open position when the temperature sensor reads the predetermined ambient temperature. In some aspects, the valve is configured to move from the open position to the closed position when the temperature sensor reads the predetermined ambient temperature.

In further aspects, the solenoid can be configured to operate the valve to allow a predetermined flow of water or liquid through the valve sufficient to prevent water or liquid in the supply pipe from freezing. In yet further aspects, the solenoid can be in mechanical communication with the valve. In even further aspects, the solenoid can be configured to move the valve from the closed position to the open position when the solenoid is energized. In still further aspects, the solenoid can be configured to allow the valve from the open position to the closed position when the solenoid is not energized. In yet further aspects, the solenoid valve may be configured to stay open until it receives a pulse of energy to close. In some aspects, the valve is configured to move from the open position to the closed position when the solenoid is not energized. In other aspects, the valve can comprise a solenoid valve, for example, a valve having an integral solenoid or other electro-mechanical component capable of actuating the valve. In further aspects, the solenoid valve can comprise a piloted solenoid valve, or direct acting solenoid, or the like. In some aspects, the liquid may be a water-based liquid having similar physiochemical properties as water.

In further aspects, the controller can be configured to receive and/or utilize the temperature data to control the valve position upon meeting predetermined criteria. In still further aspects, the controller can be configured to control the solenoid or solenoid valve. In yet further aspects, such as when a first predetermined criteria is met, the controller can be configured to cause the solenoid valve to be in the closed position, thereby preventing water or liquid from flowing from the supply pipe through the solenoid valve opening. In even further aspects, such as when a second predetermined criteria are met, the controller can be configured to cause the solenoid valve to be in the open position, thereby allowing water or liquid from the supply pipe to flow through the solenoid valve opening. In yet further aspects, the controller can be configured to receive temperature data from the temperature sensor, and further configured to determine the solenoid valve position based on the temperature data received from the temperature sensor. In some aspects, the controller can be configured to cause the solenoid valve position to be in the closed position when the temperature data received from the temperature sensor is above a predetermined threshold. In other aspects, the controller can be configured to cause the solenoid valve position to be in the open position when the temperature data received from the temperature sensor is below a predetermined threshold.

In further aspects, the controller can be configured to change the valve position by controlling electrical power to the solenoid from the power source. In still further aspects, the controller can be configured to move the valve position to the open position by delivering electrical power from the power source to solenoid when the temperature data received from the temperature sensor is below a predetermined threshold. In yet further aspects, the controller can be configured to move the valve position to the closed position from the open position by disconnecting electrical power to the solenoid when the temperature data received from the temperature sensor is above a predetermined threshold.

In various aspects, the device can comprise a plurality of temperature sensors. In further aspects, the temperature sensor can be further configured to determine temperature data of the water or liquid flowing through the valve opening or supply line. In yet further aspects, the temperature sensor can comprise an external temperature sensor, remote temperature sensor, wireless temperature sensor, or the like. In still further aspects, the external temperature sensor can be connected to the device by a wire.

In further aspects, first temperature data may comprise temperature data associated with an environment or air outside of a dwelling, for example, the air outside of a house or is building to which the device is connected. In yet further aspects, second temperature data may comprise temperature data associated with an environment or air adjacent to the device. In still further aspects, air adjacent to the device may comprise air that is in thermal communication with at least a portion of the device or device housing. In even further aspects, air adjacent to the device may comprise air in an environment to which least a portion of the device or device housing is connected. In still further aspects, air adjacent to the device may comprise at least one of: air inside of a dwelling to which the device is connected and air outside of the dwelling to which the device is connected. In some aspects, air adjacent to the device is air inside the dwelling. In other aspects, air adjacent to the device is air outside of a dwelling to which the device or a portion of the device is connected.

the first predetermined criteria can comprise temperature data above a predetermined threshold. In still further aspects, the first predetermined criteria can comprise air temperature data above a predetermined threshold. In yet further aspects, the first predetermined criteria can comprise water temperature data above a predetermined threshold. In even further aspects, the second predetermined criteria can comprise temperature data below a predetermined threshold. In still further aspects, the second predetermined criteria can comprise air temperature data below a predetermined threshold. In yet further aspects, the second predetermined criteria can comprise water temperature data below a predetermined threshold. In some aspects, the predetermined threshold can be a predetermined temperature. In other aspects, the predetermined temperature can be the temperature of the air or water is at, near, above or below the freezing temperature of water, such as for example, from about 28 to about 40° F.

In various aspects, the flow control component may comprise a drip emitter or dripper. In further aspects, the flow control component can comprise a flow control orifice, or a pressure compensating or pressure regulating dripper. In yet further aspects, the flow control component is positioned after the valve opening in a flow passage of the valve. In still further aspects, the flow control component can be preconfigured at a fixed flow rate or configured to allow adjustment within the flow passage to control the drip rate. In yet further aspects, the device can further comprise a flow meter configured to measure a flow rate of the water or liquid through the valve opening or flow control component.

In further aspects, the housing may be manufactured of a flexible or pliant material such as for illustrative purposes a natural or synthetic woven or non-woven fabric, a rubber or other flexible polymer material, a silicone-based material, or may be a rigid material, such as a plastic, metal or wooden casing, wherein the casing is a container with walls to define an enclosed area. Other flexible or pliant or other materials may be employed. In still further aspects, the housing can be any shape, such as a water droplet, and may be in the shape of a three-dimensional polygon and the housing walls may define an interior space or interior sections for containing the operating elements of the presently disclosed subject matter. Any other shape (as used herein, the term shape is used in the broad sense of three-dimensional works) may be employed, so long as the shape is large enough and structured so as to be able to contain the various working components of the presently disclosed subject matter as more fully disclosed below.

In further aspects, the devices may further comprise on opening through a wall or outer surface of the housing for providing an amplifier that is connected to the controller or a sound element contained within the device. In still further aspects, the device may comprise an opening through the outer surface for providing a light, such as an LED light, that is connected to the controller or a timing element contained within the device. A light (and/or sound) may be turned on when vibration is initiated and turned off when power to the vibration element is turned off. Alternatively, powering on the device may also power on a timing element, and optionally a light (and/or sound), so that when a desired time period has occurred, the timing element may turn off the light (and/or sound) or may turn off a light (and/or sound) and the vibration element, or the timing element or controller may turn on sound or light after a period of vibration. Alternatively, the timing element may be under a control that is separate from a control for the vibration element. Components for switches, controller, such as a polycarbonate circuit board and the programming to accomplish the disclosed activities and others, and elements such as timing elements, sound elements and lights, are known, and can be selected or commercially acquired by those of skill in the art. Wires for connecting the elements within the device or on the surface are contemplated by the presently disclosed subject matter.

In various aspects, the device may comprise one more switch for activating a device component. In further aspects, the switch may be in operative communication with the valve for selectively moving the valve from at least one of: a closed position to an open position and an open position to a closed position. In still further aspects, the switch may be communicatively connected to the controller and configured to selectively activate the actuator to move the valve from at least one of: a closed position to an open position and an open position to a closed position. In even further aspects, a switch may be a common switch and is used to turn the actuator on and off. The switch may also control power transmission to a control element or other element of the device, such as a motor or a light. The switch can be secured to the housing at any convenient position where it may readily be actuated or accessed remotely by wired or wireless components. As shown in FIG. 1, the switch may be a push button switch. The switch is electrically connected in a known manner between the power source and the actuator to control the application of power to the motor. In an aspect, when the actuator is switched on, the force produced from the actuator, such as the various types of motors disclosed above, will be transmitted through the gears to the valve.

In still further aspects, a device of the presently disclosed subject matter may have more than one switch, each of which may control the power to an element of the device or provide on/off control of the element itself, and discussion of one switch is not to be seen as limiting to the presently disclosed subject matter. A switch can be a common on/off switch, such as a toggle, lever, push-button, capacitance or other switch.

In further aspects, the power source can comprise a battery, DC power supply, AC power supply, solar power, or the like. In still further aspects, the device can be configured to threadably attach to the spigot or spout. In yet further aspects, the device can be configured to attach by screwing the device directly onto the spigot or spout. In even further aspects, the device can be attached using a connecting means. In still further aspects, the connecting means can comprise a fitting, insert, adhesive, brazing, soldering, welding, spot weld, screw with nut, rivet, threading, friction fit, snap-fit, twist-lock, or interlocking mechanism or a combination thereof. In yet further aspects, the connection can be achieved using a snap, friction fitting, snap ring, O-ring, pressure fitting, clip, clasp, and the like. The snap ring or O-ring can be retained within a groove to accommodate the snap ring or O-ring. In a further aspect, the system can comprise an engagement means for coupling and holding components together. In a further aspect, the engagement means can be a screwing mechanism, a click-lock mechanism, or friction mechanism, or the like.

In further aspects, the device can further comprise a display unit configured to show information related to device status, settings, parameters, or performance. In still further aspects, the display unit can be further configured to generate a User Interface (UI), wherein the UI is configured to enable a user of the flow control device to perform management of the flow control device. In some aspects, the device can further comprise a communication unit configured to communicate with a client device or remote monitoring device. In other aspects, the controller can be further configured to generate a Graphical User Interface (GUI) presentable on a client device, wherein the GUI is configured to enable a user of the client device to perform management of the flow control device.

As described herein, faucet adaptor is configured to and may be connected to an end of a water faucet and an opening or connector of the flow control device or device housing. Accordingly, the device or device housing may be connected and mounted to the faucet via faucet adaptor. In further aspects, the faucet adapter may be configured to either: divert the water into the device housing along the controlled liquid flow path or 2) allow the water to pass through the adapter, and out along the bypass liquid flow path. The faucet adapter may comprise a diverter or bypass valve disposed within a portion of the adapter, which is configured to direct the fluid to the controlled liquid flow path in a first position or orientation; or direct the fluid out along the bypass liquid flow path in a second position or orientation. The device housing and/or faucet adapter housing may be configured to be easily screwed onto a faucet, an external spigot or spout of a supply pipe.

In further aspects, faucet adapter may comprise at least one of: a faucet adapter connector, an adapter housing, a bypass component for changing or diverting a flow path of a liquid. The bypass component may comprise an elongated member or shaft, and a bypass valve for controlling the flow path. In still further aspects, the faucet adapter connector may comprise a threaded faucet insert and/or swivel connector. The faucet adapter may use adapter connector to connect to faucet end and an end of adapter housing which is defined by a first opening. Bypass component may connect to adapter housing via an aperture, such that at least a portion of the bypass member and bypass valve are disposed inside the inner chamber of the adapter housing. Bypass member comprises first and second openings at the bypass valve end (i.e., portion configure to be disposed within the adapter housing), and a threaded connector portion at the opposed end, which is configured to threadably attach to a corresponding female opening of the flow control device.

Depending on operation mode and position, the faucet adapter is configured to either: divert water into an attached flow device housing along a controlled liquid flow path or 2) allow the water to pass directly through the faucet adapter along a bypass liquid flow path. In a first or "on" position, the bypass valve is a closed position covering the second opening of the bypass member and the threaded connector portion is oriented such that a flow control device attach thereto would be substantially parallel with adapter housing opening. In this on position, the water or liquid flow path will start from a water input via a faucet, then enter through the faucet adapter, then through a first opening of the bypass member and along a channel formed within the bypass member, then into the device housing and through the valve of the device, then through the flow control component, and then out of the flow control device through the inner channel.

In a second "bypass" or "off" position, the bypass valve is in an open position exposing the second opening of the bypass member and the threaded connector portion is oriented such that a flow control device attach thereto would be substantially perpendicular with adapter housing openings. In this bypass position, since both the first and second openings of the bypass member are open, the water or liquid flow path will start from a water input via a faucet, then enter through the faucet adapter, then through the first and second openings of the bypass member, and out of the faucet adapter.

In further aspects, a flow control device attached to the faucet adapter or the threaded connector end may be used to turn or rotate the bypass member between the on/off positions. In still further aspects, when bypass member has been rotated about 90 degrees from on position to off position or vice versa, (e.g., clockwise or counter-clockwise direction) a tactile signal may be provided to indicate to a user the bypass valve has been fully opened and/or closed as further described herein. For example, in a first position, bypass valve is in a closed position, permitting liquid to flow through the bypass member chamber into the flow control device. When user rotates bypass member back ninety degrees in the opposite direction to a second position, bypass member causes the reciprocal operations to take place to cause bypass valve to move to an open position, permitting liquid to flow through the first and second opening of the bypass member and out the faucet adapter housing.

In further aspects, the actuator may be configured to actuate automatically under the control of the controller when predetermined temperature conditions are met. By way of non-limiting example, the controller may activate motor and gears when the outside air temperature is at or near freezing as sensed by a remote temperature sensor. When the actuator is activated, water is allowed to flow out of the supply line and through the valve opening. When the temperature of the air rises to a predetermined temperature above freezing, the controller activates the motor and gears to close the valve, thereby preventing water from flowing through valve opening. In alternative aspects, the actuator may be a solenoid that is energized under the temperature conditions than previously described and the same result may be reached. The chosen component configuration would depend on whether the valve is usually open or closed.

In further aspects, the device can be waterproof. In still further aspects, the device components can be in an integral assembly. In yet further aspects, the device components can be all housed within the housing such that they are protected from, for example, for inadvertent shutting off or the environmental elements. In even further aspects, the housing can be comprised of plastic, plastic composite, reinforced plastic, metal, metal composite, or combinations thereof. In still further aspects, the plastic can comprise polypropylene, impact resistant plastic, or the like. In some aspects, the further comprise glass or carbon fiber, or the like.

In still further aspect, the components can be integrally or mechanically attached to other components. In a yet further aspect, the disclosed components can be connected, attached, or mounted using a connecting means, the connecting means comprising a fitting, insert, adhesive, brazing, soldering, welding, spot weld, screw with nut, rivet, fitting, insert, threading, friction fit, or snap-fit or a combination thereof.

In various further aspects, the present disclosure also relates, to methods of using the disclosed flow control devices, for example, to easily install on indoor or outdoor water spigot and prevent rupture of pipes during freezing temperatures. In further aspects, the flow control device can be adapted to fit any number of pipe spigot and spout configurations.

In various aspects, also disclosed herein are kits comprising one or more disclosed devices. For example, according to aspects, a kit can comprise a disclosed flow control device and instructions for using the disclosed flow control device in conjunction with a water spigot or spout, or the like.

In various aspects, the disclosed devices, systems, and methods provide numerous advantages over current solutions or flow control devices. In further aspects, the disclosed devices and methods provide a new method for preventing frozen and ruptured water pipes. In still further aspects, the inventive design and configuration improve how the flow control device is installed and used, and according to some aspects, the present device has a flow control component in the outlet which self-regulates the drip rate. In some aspects, the presently disclosed subject matter comprises no exposed components that affect device performance or that can otherwise be inadvertently turned on, such as outflow, causing a greater or lesser amount of outflow than desired. In other aspects, the present device can be configured to uses the temperature sensor to monitors the ambient temperature multiple times per second, which can be more precise determination of dropping temperatures, and measures the air temperature outside, which can be more accurate for preventative purposes.

In further aspects, the disclosed devices and systems do not require: professional install, knowledge of the exact "point most likely to experience freezing temperatures", electricity, or Wi-Fi to function or otherwise provide protection from burst frozen pipes. In still further aspects, the disclosed devices have a vertical construction and configuration that allow liquid to flow through the channel or conduit of the device housing. Horizontally constructed device may be more prone to blockages, such as those caused by frozen residual water. In still further aspects, the disclosed devices do not require or rely on use of a thermal switch to activate an actuator or solenoid controlling the valve. Without wishing to be bound by a particular theory, thermal switch operation may be a function of thermal conductivity of the pipe which monitors the temperature of the pipe, and therefore, has to be made out of a relatively high thermal conductor. In yet further aspects, prior devices may often activate to open when a water temperature is near freezing, and thus, could be susceptible to failure from accumulated ice crystals formed in the tube and block solenoid operation. Similarly, these devices may close once warmer water enters through the pipe.

In further aspects, the disclosed devices of the presently disclosed subject matter utilize self-regulating mechanism for controlling the drip rate, whereas drip rate in prior devices often rely on the user to manually adjust the amount of outflow. In yet further aspects, a user may not know how much or how little outflow to allow, and an exposed knob that adjusts outflow could be inadvertently turned by others causing a greater or lesser amount of outflow than desired. In still further aspects, the disclosed devices may utilize a plurality of temperature data sources for operating the valve or actuator. Prior devices may rely on different coefficients of expansion of the plastic and metal parts of the device. The mechanical devices may exclusively rely and operate based on the thermal expansion of the gas based on freezing temperatures. For example, prior devices may rely on the mechanical retraction of a manually adjusted temperature monitoring device to allow water flow. This type of adjustment is not common knowledge for a typical homeowner, or to otherwise know the tension one has to adjust for freezing temperatures, particularly in view of water with high ionic concentrations freezing at a lower temperature than distilled water.

According to various aspects of the presently disclosed subject matter, the disclosed devices, systems, and methods can comprise multiple configurations. For example, aspects of various exemplary embodiments of the inventive flow control devices, systems, and methods are shown in FIGS. 1 through 5D.

Figure 4:
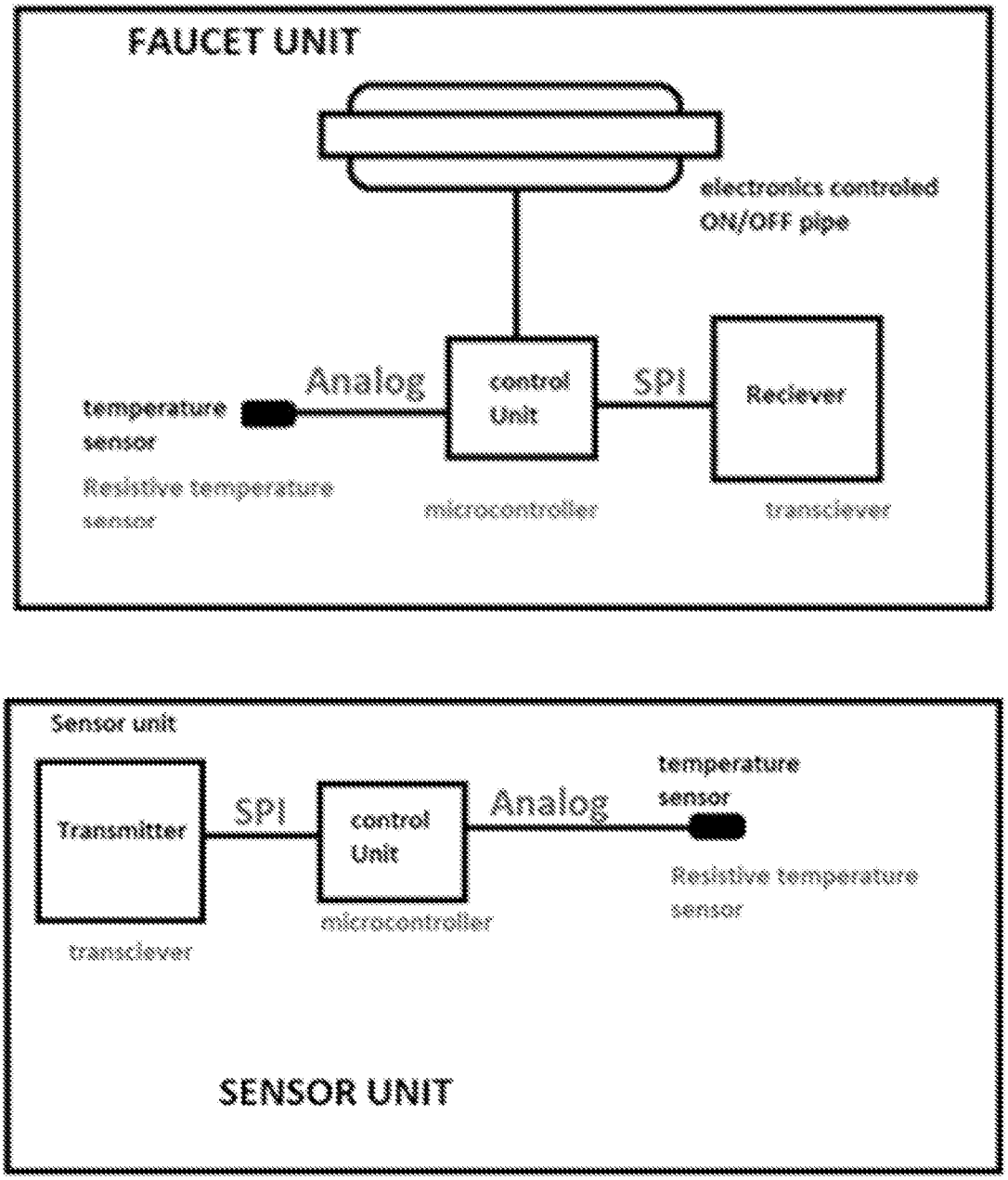
FIG. 4 shows a diagram depicting a flow control system in accordance with an exemplary embodiment of the presently disclosed subject matter.

In further aspects, FIGS. 1 and 4 illustrate examples of flow control devices according to the presently disclosed subject matter. FIG. 1 shows various aspects of an exemplary system 100 for preventing freeze-induced rupture of a supply pipe in accordance with the presently disclosed subject matter. The system 100 comprise at least one remote temperature sensor configured to determine first temperature data associated with air outside of a dwelling; a flow control device 101 configured to releasably attach to a faucet or spigot of a supply pipe comprising: a valve 103 configured to control a first flow rate of the liquid flowing from an inlet of the supply pipe along a controlled liquid flow path by moving a valve position from a closed position to an open position; a flow control component 104 in fluid communication with the valve 103, and configured to control a second flow rate of the liquid flowing from the valve 103; at least one internal temperature sensor 105 configured to determine second temperature data associated with air adjacent to the device 101; a controller 107 communicatively connected to the temperature sensors and configured to control operation of the valve 103 based at least on at least one of the first temperature data and the second temperature data; and a housing 109 configured to contain the flow control device components and further configured to releasably attach to a spigot or spout of a supply pipe; and in this embodiment, a faucet adapter 111 configured to detachably couple the flow control device 101 to the faucet such that the inlet is placed in fluid communication with a first opening of the faucet adapter 111.

In further aspects, the flow control device 101 also includes an actuator comprising motor 115 and gears 117 configured to actuate the valve 103 from at least one of: a closed position to an open position and an open position to a closed position; a switch 119 communicatively connected to the controller 107 and configured to selectively activate the actuator to move the valve 103 from at least one of: a closed position to an open position and an open position to a closed position; connector 121 configured to attach to an end of the faucet adapter 111 or directly to an end of a faucet or spigot; a power source 123 for powering one or more device components in electrical communication with the device; and an inner channel 125 and channel plug 127 configured to direct water out of the device 101.

In still further aspects, the actuator is configured to control opening and closing of the valve. In other aspects, the actuator can comprise any desired electro-mechanical device capable of actuating the valve under the control of a controller and/or when predetermined criteria or operating parameters are met. As shown in FIG. 1, the motor 115 and gears 117 are connected to the valve 103 to actuate the valve position from open to close based on operating instruction from the controller. After installing flow control device 101 directly to an interior faucet (with or without the use of faucet adapter 111), the controller 107 communicates wirelessly (e.g., Bluetooth, RF, Wi-Fi, etc.) with a remote temperature sensor (not shown) installed or located outside the dwelling or home to gather temperature data used for valve 103 and flow control operations. The controller 107 is in operable and/or electrical communication with a plurality of temperature sensors, such as internal temperature sensor 105, and power source 123 to control the valve position.

When the valve 103 is in an open position, the flow control component is configured to control the flow rate of the water or liquid traveling through the housing 109 along the controlled liquid flow path. In some aspects, the liquid or water from an inlet of the supply line will initially enter through faucet adapter 111. As shown in FIG. 1, faucet adapter 111 comprises a faucet adapter connector, including threaded faucet insert 129 and swivel connector 131, housing 133, and bypass component 135, including bypass member 137 and bypass valve 139.

The faucet adapter 111 uses threaded faucet insert 129 and swivel connector 131 to connect to faucet end and a first end of adapter housing 133 which is defined by a first opening. Bypass component 135 connects to adapter housing 133 via a side aperture, such that the bypass member 137 and bypass valve 139 are disposed in the inner chamber formed by the adapter housing 133. Bypass member 137 comprises first and second openings at the bypass valve 139 end (i.e., portion configure to be disposed within the adapter housing), and a threaded connector portion at the opposed end, which is configured to threadably attach to a corresponding female opening of the flow control device 101.

Depending on operation mode and position, the faucet adapter 111 is configured to either: divert water into an attached flow device housing along a controlled liquid flow path or 2) allow the water to pass directly through the faucet adapter 111 along a bypass liquid flow path.

In a first or "on" position, the bypass valve 139 is a closed position covering the second opening of the bypass member 137 and the threaded connector portion is oriented such that a flow control device 101 attach thereto would be substantially parallel with adapter housing 133 opening. In this on position, the water or liquid flow path will start from a water input via a faucet, then enter through the faucet adapter 111, then through a first opening of the bypass member 137 and along a channel formed within the bypass member, then into the device housing and through the valve of the device, then through the flow control component, and then out of the flow control device 101 through the inner channel 125.

In a second "bypass" or "off" position, the bypass valve 139 is in an open position exposing the second opening of the bypass member 137 and the threaded connector portion is oriented such that a flow control device 101 attach thereto would be substantially perpendicular with adapter housing 133 openings. In this bypass position, since both the first and second openings of the bypass member 137 are open, the water or liquid flow path will start from a water input via a faucet, then enter through the faucet adapter 111, then through the first and second openings of the bypass member 137, and out of the faucet adapter 111.

FIG. 4 illustrates one example of an internal component configurations of a flow control device and remote temperature sensor, each comprising a controller, a transceiver (e.g., Lora or Bluetooth LE transceiver), and a temperature sensing element. In other embodiments, the device and remote sensor unit may comprise a wireless charging system comprising a battery charging module, wireless power receiver (e.g., wireless power coil), and wireless power control module. The system and devices comprise a plurality of temperature sensors, including both internal and remote temperature or thermal sensor configured to determine air temperature data outside, and inside the dwelling where the device is installed.

Figure 2:
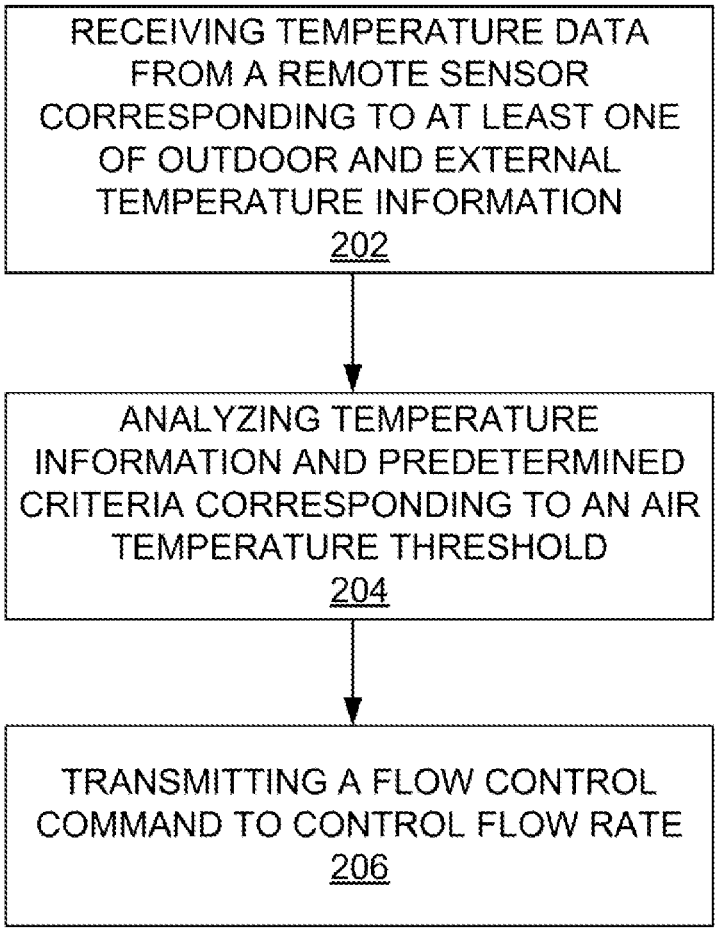
FIG. 2 shows a flowchart depicting a method of controlling flow of a water pipe in accordance with an exemplary embodiment of the presently disclosed subject matter.

As described herein, also disclosed are various methods of using the disclosed devices to prevent freeze-induced rupture of a water lines or supply pipes. FIG. 2 shows a flow chart setting forth the general stages involved in a method 200 consistent with various embodiment of the disclosure for controlling flow of a water pipe. Method 200 may be implemented using a device 100 as described in more detail above with respect to FIG. 1, or, at least in part, with a controller 1100 (e.g., on-board computing device) as described in more detail with respect to FIG. 3. To this end, while method 200 has been described to be performed using system 100 or device 101, it should be understood that controller 1100 may be used to perform the various stages of method 200. Controller 1100 may comprise a controller for operating the device and device components as well as well as performing other operational tasks, including, but not limited to, valve or flow control and parameters, temperature parameters, and communication. As such, controller 1100 may be in operative configuration and communication with, for example, but not be limited to, temperatures sensors, activating switch, communication module, power source, power regulator, various telemetry sensors, transceivers and antennas. As will be detailed with reference to FIG. 3, controller 1100 may comprise a remote communication module to enable remotely operation as described herein. In other embodiments, controller 1100 may be completely self-operating upon configuration.

Furthermore, although stages are disclosed with reference to controller 1100, it should be understood that a plurality of other components may enable the operation of method 1000, including, but not limited to, other computing components, mechanical components, environment properties (e.g., temperature), user conditions, and the like.

Further still, although the stages illustrated by the flow charts are disclosed in a particular order, it should be understood that the order is disclosed for illustrative purposes only. Stages may be combined, separated, reordered, and various intermediary stages may exist. Accordingly, it should be understood that the various stages illustrated within the flow chart may be, in various embodiments, performed in arrangements that differ from the ones illustrated. Moreover, various stages may be added or removed from the flow charts without altering or deterring from the fundamental scope of the depicted methods and systems disclosed herein.

The method 200 may be used for controlling flow rate and or drip rate to one or more pipes or supply lines or fixtures, in accordance with some embodiments. At step 202, the method may receive, using the temperature sensor or a thermostat, temperature data corresponding to one or more outdoor air temperatures external to one or more pipes or supply lines or fixtures. In further aspects, the external temperature may be the air temperature external of the supply line, for example, inside of a dwelling or structure and external of the supply line. Further, at step 204, the method may analyze, using a microcontroller or controller, the temperature data corresponding to one or more outdoor air temperatures external to one or more pipes or supply lines to determine if the air temperatures meet predetermined criteria comprising air temperature data below or above a predetermined threshold, such as for example, near, above or below the freezing temperature of water, for example, from about 28 to about 40° F. Additionally, at step 206, the method may transmit, using a microcontroller, thermostat, communication unit, or controller, a control command to control the flow rate of the water, for example, by causing the solenoid valve to be in the closed position, thereby preventing water or liquid from flowing from the supply pipe through the solenoid valve opening, or by causing the solenoid valve to be in the open position, thereby allowing water or liquid from the supply pipe to flow through the solenoid valve opening. In further aspects, the flow control component can further control the drip rate flowing from the valve opening. In some embodiments, the water or liquid flow path will start from a water input via a faucet or spigot, then through a faucet or spigot adapter, then through the valve of the device, then through the flow control component, then out of the device through an inner channel or tube. In further aspects, the channel may be an integrated or formed cavity within the housing or between coupled halves of the housing. In other embodiments, the faucet or spigot adapter, or a portion thereof, may be turned or otherwise repositioned to change the liquid flow path to bypass the device. In this aspect, the water or liquid flow path will still start from a water input via a faucet or spigot, then through a faucet or spigot adapter, but directly out of the adapter. In further aspects, the adapter, when used in conjunction with the disclosed devices, allows for the faucet or spigot to be utilized even while a flow control device is attached to the faucet or spigot.

In various aspects, an advantage of the presently disclosed subject matter can be that it allows a user to install the device inside the home without a professional, and the device can activate the valve and/or flow control based on temperature data remotely retrieved from the device. In further aspects, a user does not have to pick up the device to: activate its operation, to shut off operation, and/or in embodiments that allow for adjustment, to adjust the flow level and/or thermal parameters. In some aspects, the device may not require wi-fi or wireless communication, (e.g., to communicate with a server or wireless client device) to function, such as to receive instructions or operation commands for activating the actuator or valve. In some aspects, the device may not require an external power source, such as household electricity to function. In still further aspects, the device can advantageously continue to function and provide protection from burst frozen pipes during power and internet outages.

In further aspects, a user may activate or de-activate (and/or otherwise control operation of) the valve and/or flow rate by using a control unit, such as a wireless device or mobile device that is in operative communication with the controller and/or actuator of the device. The wireless device may be a device that may be used for additional purposes other than use with the presently disclosed subject matter such as a mobile phone, tablet computer, notebook computer, desktop computer, etc. In some embodiments, the presently disclosed subject matter may provide a specialized wireless device for dedicated use with the presently disclosed subject matter. In other embodiments, the specialized wireless device may include other uses if its use is not limited to this particular embodiment of the presently disclosed subject matter.

As provided in more detail herein, the wireless unit used to control the device may include an application or application software (an "app") specifically created for such usage. Advantageously, the user may download and/or otherwise obtain the app from sources that supply apps such as independent developers and app stores. The app as used with embodiments of the presently disclosed subject matter communicates wirelessly, such as by using Bluetooth, Wi-Fi, or the like technology.

In various aspects and stages of the disclosed methods, the device may be in operable communication with a user or remote sensors via an antenna or wireless communication component. The user may receive various readings from the various device components. In some embodiments, the user may control the operation of the vibration source and/or thermal elements during use. For example, the user may be able to control the device components, including, but not limited to, vibrational sources or elements, thermal elements, activating switches, communication module, power source, power regulator, various telemetry sensors, transceivers and antennas.

In other embodiments, integrated controller 1100 may be pre-configured with operational control instructions and/or data.

In various aspects, the disclosed devices may comprise, but not be limited to, an integrated controller and/or onboard computing module. The computing module may be in operative configuration and communication with, for example, but not be limited to, internal and remote temperature sensors, thermal elements, activating switch, communication module, power source, power regulator, various telemetry sensors, transceivers and antennas. Further, the computing module may be in operative communication with another computing device consistent with the description herein, and may comprise, but not be limited to, a wireless device, smart phone, desktop computer, laptop, a tablet, or mobile telecommunications device. Such remote devices may be used to control and/or configure integrated computing module (e.g., activation conditions, flow rate, operating parameters and settings, thermal operating parameters and settings and the like).

Moreover, the device may be in operative communication with a centralized server, such as, for example, a cloud computing service. Although operation has been described to be performed, in part, by a controller 1100, it should be understood that, in some embodiments, different operations may be performed by different networked elements in operative communication with controller 1100.

Embodiments of the present disclosure may comprise a system having a memory storage and a processing unit. The processing unit may be coupled to the memory storage, wherein the processing unit is configured to perform the stages of method 1000.

Figure 3:
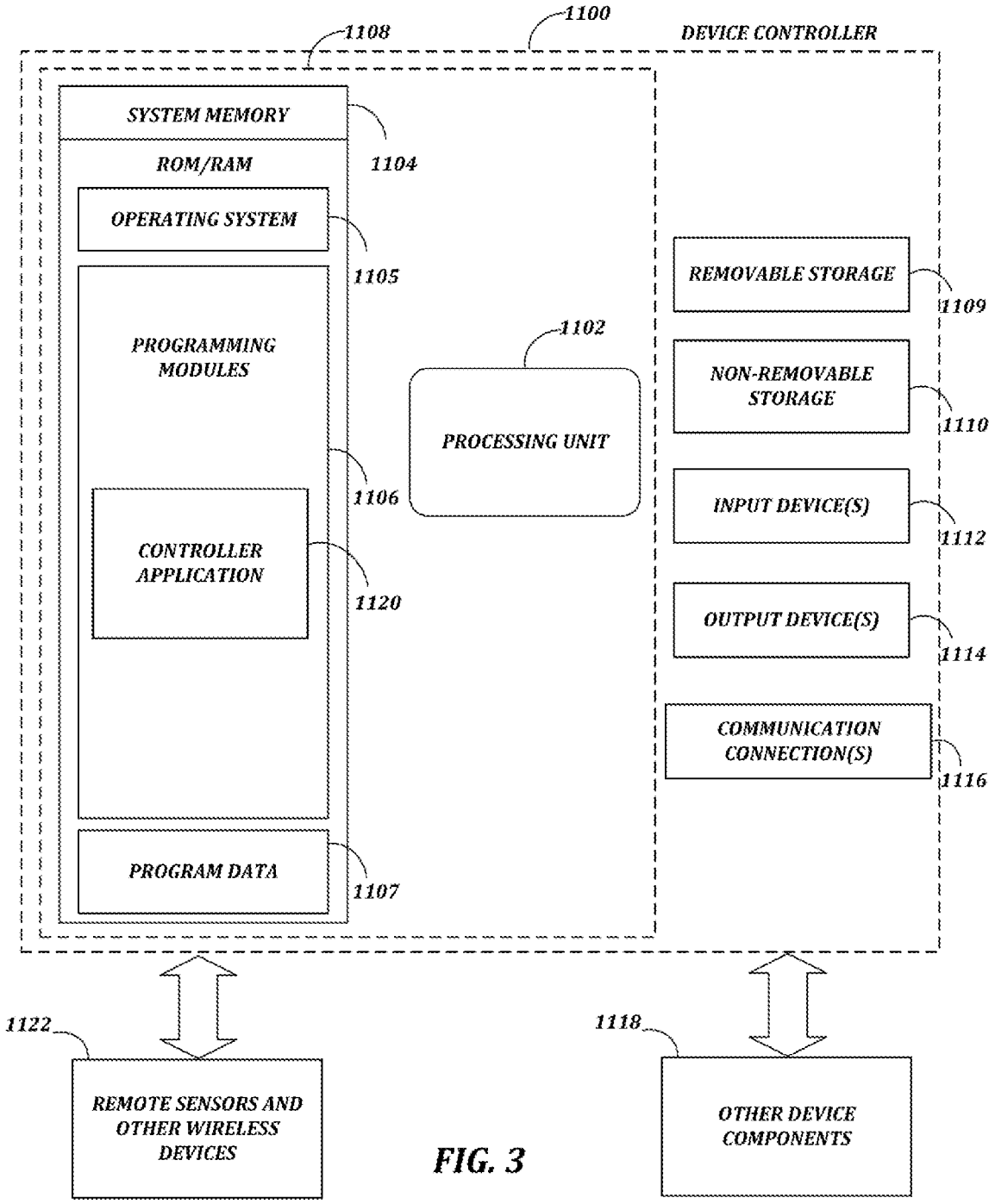
FIG. 3 shows a block diagram of a system including a controller for performing a disclosed method in accordance with an exemplary embodiment of the presently disclosed subject matter.

FIG. 3 is a block diagram of a system including controller 1100. Consistent with an embodiment of the disclosure, the aforementioned memory storage and processing unit may be implemented in a computing device, such as controller 1100. Any suitable combination of hardware, software, or firmware may be used to implement the memory storage and processing unit. For example, the memory storage and processing unit may be implemented with controller 1100 or any device components 1118, or any other remote temperature sensors and wireless devices 1122, in combination with controller 1100. Other device components 1118 may comprise, for example, but not be limited to, control mechanisms, actuators, flow control mechanisms, activating switch, communication module, power source, power regulator, various telemetry sensors, transceivers and antennas. The aforementioned system, device, and processors are examples and other systems, devices, and processors may comprise the aforementioned memory storage and processing unit, consistent with embodiments of the disclosure.

With reference to FIG. 3, a system consistent with an embodiment of the disclosure may include a computing device, such as controller 1100. In a basic configuration, controller 1100 may include at least one processing unit 1102 and a system memory 1104. Depending on the configuration and type of computing device, system memory 1104 may comprise, but is not limited to, volatile (e.g., random access memory (RAM)), non-volatile (e.g., read-only memory (ROM)), flash memory, or any combination. System memory 1104 may include operating system 1105, one or more programming modules 1106, and may include a program data 1107. Operating system 1105, for example, may be suitable for controlling controller 1100's operation. In one embodiment, programming modules 1106 may include controller application ("app") 1120. Furthermore, embodiments of the disclosure may be practiced in conjunction with a graphics library, other operating systems, or any other application program and is not limited to any particular application or system. This basic configuration is illustrated in FIG. 3 by those components within a dashed line 1108.

In some embodiments, the app may provide a user with information as well as be the user's interface to operating the embodiment of the presently disclosed subject matter. The app may include one or more graphic user interfaces (GUIs). Among the GUIs of the app may be a GUI allowing the user to pick which, if there is more than one, flow control device and/or valve to activate, and to select (if available) one or more operating parameters or characteristics (such as flow rate, and/or max/min temperature) of the valve, actuator and/or flow control components of the device. The user may also use the app to turn on and turn off the device components.

The GUI may include additional or other information relating to the outside and inside temperature or flow rate of the liquid through the controlled liquid flow path. The additional or other information may be color coded and/or otherwise presented so as to be readily understood by the user by looking at the GUI of the app. The app may also present the user with information received from the device components, such as environmental and telemetry data.

Controller 1100 may have additional features or functionality. For example, controller 1100 may also include additional data storage devices (removable and/or non-removable) such as, for example, magnetic disks, optical disks, or tape. Such additional storage is illustrated in FIG. 3 by a removable storage 1109 and a non-removable storage 1110. Computer storage media may include volatile and nonvolatile, removable and non-removable media implemented in any method or technology for storage of information, such as computer readable instructions, data structures, program modules, or other data. System memory 1104, removable storage 1109, and non-removable storage 1110 are all computer storage media examples (i.e., memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by controller 1100. Any such computer storage media may be part of device 1100. Controller 1100 may also be operative with input device(s) 1112 such as a keyboard, a mouse, a pen, a sound input device, a touch input device, etc. Input device(s) 1112 may be used to, for example, manually access and program controller 1100. Output device(s) 1114 such as a display, speakers, a printer, etc. may also be included. The aforementioned devices are examples and others may be used.

Controller 1100 may also contain a communication connection 1116 that may allow device 1100 to communicate with other control units and wireless devices 1122 as well as temperature sensors, thermal elements, and other components 1118 (e.g., transceivers, sensors, actuators), such as over an encrypted network in a distributed computing environment. Communication connection 1116 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, Bluetooth, radio frequency (RF), infrared, and other wireless media. The term computer readable media as used herein may include both storage media and communication media.

As stated above, a number of program modules and data files may be stored in system memory 1104, including operating system 1105. While executing on processing unit 1102, programming modules 1106 (e.g., controller application 1120) may perform processes including, for example, one or more of stages or portions of stages of method 1000 as described above. App 1120 may be configured to operate device components 1118 and receive instructions from, for example, communications connections module 1116. The aforementioned process is an example, and processing unit 1102 may perform other processes.

Generally, consistent with embodiments of the disclosure, program modules may include routines, programs, components, data structures, and other types of structures that may perform particular tasks or that may implement particular abstract data types. Moreover, embodiments of the disclosure may be practiced with other computer system configurations, including hand-held devices, multiprocessor systems, microprocessor-based or programmable consumer electronics, minicomputers, mainframe computers, and the like. Embodiments of the disclosure may also be practiced in distributed computing environments where tasks are performed by remote processing devices that are linked through a communications network. In a distributed computing environment, program modules may be located in both local and remote memory storage devices.

Furthermore, embodiments of the disclosure may be practiced in an electrical circuit comprising discrete electronic elements, packaged or integrated electronic chips containing logic gates, a circuit utilizing a microprocessor, or on a single chip containing electronic elements or microprocessors. Embodiments of the disclosure may also be practiced using other technologies capable of performing logical operations such as, for example, AND, OR, and NOT, including but not limited to mechanical, optical, fluidic, and quantum technologies. In addition, embodiments of the disclosure may be practiced within a general-purpose computer or in any other circuits or systems.

Embodiments of the disclosure, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present disclosure may be embodied in hardware and/or in software (including firmware, resident software, micro-code, etc.). In other words, embodiments of the present disclosure may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random-access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Figure 5A:
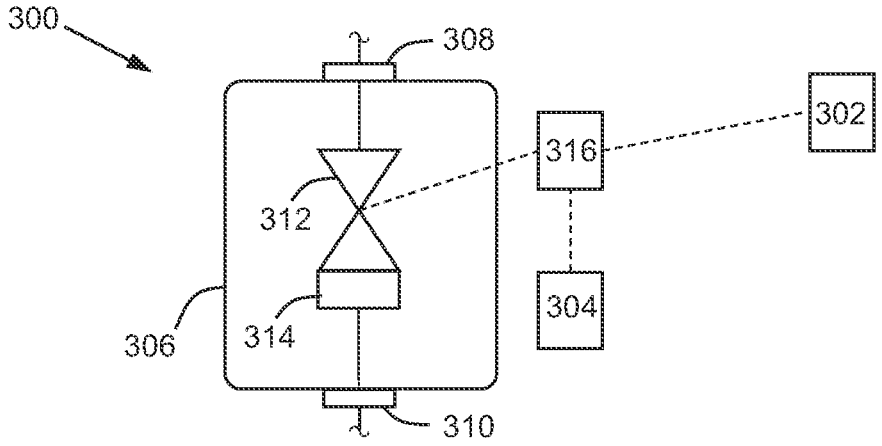
FIG. 5A schematically illustrates another example of a system for flow control according to the presently disclosed subject matter.

As illustrated in FIG. 5A, there may be provided a system, which is generally indicated at 300, for selectively releasing liquid, e.g., water, from a supply pipe, for example to prevent freeze-induced rupture thereof. The system 300 is configured to release liquid from the supply pipe directly, without requiring that a faucet or spigot be opened.

Accordingly, the system 300 comprises at least one remote temperature sensor 302 configured to determine first temperature data associated with air outside of a building in which the supply pipe is located, at least one internal temperature sensor 304 configured to determine second temperature data associated with air inside the building, for example in the immediate vicinity of the supply pipe, e.g., next to or underneath a faucet served by the supply pipe.

The system 300 further comprises a flow control device 306 configured to facilitate the selective release of liquid from the supply pipe. Accordingly, it comprises at least one inlet 308 at an upstream end thereof, at least one outlet 310 at a downstream end thereof, at least one electronically controlled valve 312, for example a solenoid valve, and at least one flow control component 314 configured to limit the flow of liquid therethrough.

The valve 312 is disposed between the inlet 308 and the outlet 310, and is moveable between a closed position in which it blocks flow of liquid therethrough, and an open position in which it permits flow of liquid therethrough.

The flow control component 314 is disposed between the inlet 308 and the outlet 310, and may comprise, e.g., a drip emitter, a flow control orifice, a pressure compensation or regulating dripper, and/or any other suitable mechanism configured to limit the flow of liquid therethrough to a predetermined small rate of flow.

The system 300 further comprises a controller 316, configured to direct operation of the system. Accordingly, the controller 300 is communicatively connected to the remote and internal temperature sensors 302, 304, e.g., to receive temperature data therefrom, and to the valve 312, e.g., to direct operation thereof, as indicated by broken lines in FIG. 5A.

The controller 316 may be configured to operate the system 300 as per the method described herein with reference to and as illustrated in FIG. 2, mutatis mutandis, and/or it may be provided as described herein with reference to and as illustrated in FIG. 3.

The controller 316 may be communicatively connected to other elements, for example a sensor (not illustrated) to monitor release of liquid via the flow control device 306, for example to ensure that liquid is being released thereby when the valve 312 is in an open position, and/or that no liquid is being released thereby when the valve is in a closed position. It may further be configured to determine that a fault may have occurred (e.g., freezing has occurred in the supply pipe, leakage is occurring in the flow control device, etc.), and optionally to issue an alert.

According to some examples, the controller may be configured to accept one or more external control signals, for example a user-initiated command to open the valve 312, irrespective of the temperature data received from the temperature sensors 302, 304.

It will be appreciated that while herein the specification and claims, the term "controller" is used with reference to a single element, it may comprise a combination of elements, which may or may not be in physical proximity to one another, without departing from the scope of the presently disclosed subject matter, mutatis mutandis. In addition, disclosure herein (including recitation in the appended claims) of a controller carrying out, being configured to carry out, or other similar language, implicitly includes other elements of the system carrying out, being configured to carry out, etc., those functions, without departing from the scope of the presently disclosed subject matter, mutatis mutandis.

It will be further appreciated that while herein the specification and claims, the flow control device 306 is described as comprising specific elements, this is a schematic representation thereof only. In practice, other elements which are not described as constituting elements thereof, e.g., the internal temperature sensor 304 and/or the controller 316, may be provided together therewith without departing from the scope of the presently disclosed subject matter, mutatis mutandis.

The inlet 308 is configured to facilitate attachment to the supply pipe. Accordingly, it may comprise any suitable arrangement, e.g., a threaded portion, etc., suitable to facilitate the connection. Similarly, the outlet 310 may be configured to facilitate attachment to a drainage pipe, and thus may comprise any suitable arrangement, e.g., a threaded portion, etc., suitable to facilitate the connection.

Figure 5B:
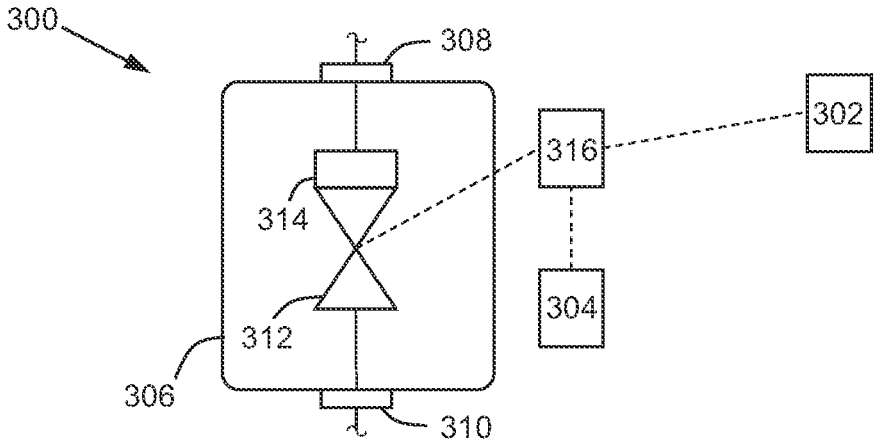
FIG. 5B schematically illustrates a modification of the system illustrated in FIG. 5B.

According to some examples, the flow control component 314 may be disposed downstream of the valve 312, i.e., between the valve and the outlet 310, for example as illustrated in FIG. 5A. According to other examples, the flow control component 314 may be disposed upstream of the valve 312, for example as illustrated in FIG. 5B.

Figure 5C:
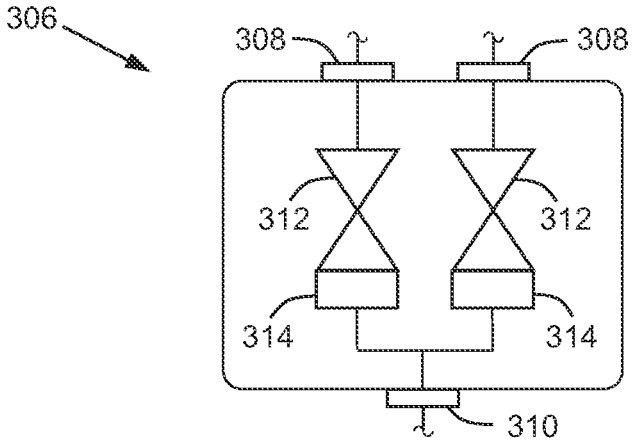
FIGS. 5C and 5D schematically illustrate modifications of a flow control device of the system illustrated in FIG. 5A.
Figure 5D:
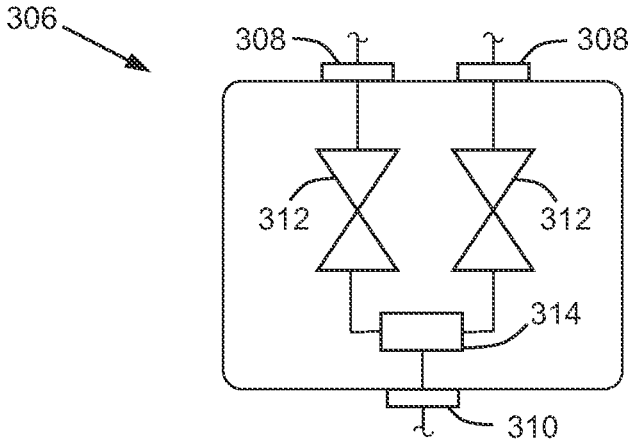

According to some examples, the flow control device 306 may be configured to facilitate selective release of liquid from more than one supply pipe. For example, as illustrated in FIG. 5C, the flow control device 306 may comprise two (or more) inlets 308, each being associated with a respective valve 312 and a respective flow control component 314 downstream thereof. According to a modification, for example as illustrated in FIG. 5D, the two (or more) valves 312 may be in fluid communication with a single flow control component 314 downstream thereof. The controller 316 may be configured to open each of the valves separately, i.e., such that only one is in an open position at a time, e.g., to prevent mixing of fluid within the two or more supply pipes, or it may be configured to allow both to be open simultaneously. These examples in which the flow control device 306 is configured to facilitate selective release of liquid from more than one supply pipe may be useful, e.g., to prevent freeze-induced rupture of hot and cold supply pipes.

It will be appreciated that the system 300 as described above with reference to and as illustrated in FIGS. 5A through 5D may be attached directly to a supply pipe, i.e., upstream of a faucet or spigot thereof. Accordingly, while it may require professional installation, and depending on its configuration may optionally require additional components, e.g., in order to prevent backflow of water between different supply pipes, it does not require that a user manually open the faucet or spigot in order for it to operate, and does not require attachment to the faucet or spigot when freezing of water within a supply pipe is anticipated or configuring a bypass component. Accordingly, it may be installed a single time, and remain in place without impacting usage of the faucet or spigot attached to the supply pipe.

As described herein, the presently disclosed subject matter may include at least the following aspects: Aspect 1: A system for preventing freeze-induced rupture of a supply pipe, the system comprising: a) at least one remote temperature sensor configured to determine first temperature data associated with air outside of a dwelling; b) a flow control device configured to releasably attach to a faucet or spigot of a supply pipe, the device comprising: i) a valve configured to control a first flow rate of the liquid flowing from an inlet of the supply pipe along a controlled liquid flow path by moving a valve position from a closed position to an open position; ii) a flow control component in fluid communication with the valve, and configured to control a second flow rate of the liquid flowing from the valve; iii) at least one internal temperature sensor configured to determine second temperature data associated with air adjacent to the device; iv) a controller communicatively connected to the temperature sensors and configured to control operation of the valve based at least on at least one of the first temperature data and the second temperature data; and v) a housing configured to contain the flow control device components and further configured to releasably attach to a spigot or spout of a supply pipe; c) a faucet adapter configured to detachably couple the flow control device to the faucet such that the inlet is placed in fluid communication with a first opening of the faucet adapter.

Aspect 2: A flow control device configured to releasably attach to a faucet or spigot of a supply pipe, the device comprising: a) at least one remote temperature sensor configured to determine first temperature data associated with air outside of a dwelling; b) a valve configured to control a first flow rate of the liquid flowing from an inlet of the supply pipe along a controlled liquid flow path by moving a valve position from a closed position to an open position; c) a flow control component in fluid communication with the valve, and configured to control a second flow rate of the liquid flowing from the valve; d) at least one internal temperature sensor configured to determine second temperature data associated with air adjacent to the device; e) a controller communicatively connected to the temperature sensors and configured to control operation of the valve based at least on at least one of the first temperature data and the second temperature data; and f) a housing configured to contain the flow control device components and further configured to releasably attach to a spigot or spout of a supply pipe.

Aspect 3: The device of any preceding claim, further comprising an actuator configured to actuate the valve from at least one of: a closed position to an open position and an open position to a closed position.

Aspect 4: The device of any preceding claim, further comprising a switch in operative communication with the valve for selectively moving the valve from at least one of: a closed position to an open position and an open position to a closed position.

Aspect 5: The device of any preceding claim, wherein the switch is communicatively connected to the controller and configured to selectively activate the actuator to move the valve from at least one of: a closed position to an open position and an open position to a closed position.

Aspect 6: The device of any preceding claim, wherein the actuator comprises at least one of: motor and gears, comb drive, linear drive, screw drive, piston, electric motor, relay, digital micromirror device, piezoelectric actuator, servomechanism, valve actuator, electric linear actuator, and electric rotary actuator.

Aspect 7: The device of any preceding claim, wherein the valve comprises a ball valve.

Aspect 8: The device of any preceding claim, wherein the valve comprises a direct acting solenoid valve.

Aspect 9: The device of any preceding claim, wherein the valve comprises a solenoid valve configured to control the valve position from open position to close position and close position to open position.

Aspect 10: The device of any preceding claim, wherein the flow control component comprises at least one of: a drip emitter, dripper, flow restrictor, and flow control orifice.

Aspect 11: The device of any preceding claim, wherein the flow control component is configured to limit the liquid flow rate while simultaneously setting a fixed flow rate.

Aspect 12: The device of any preceding claim, wherein the flow control component is configured to allow a predetermined flow of water or liquid through the flow control component sufficient to prevent water or liquid in the supply pipe from freezing (e.g., a drip emitter, dripper, flow restrictor, and flow control orifice).

Aspect 13: The device of any preceding claim, wherein the solenoid of the solenoid valve is in mechanical communication with the valve.

Aspect 14: The device of any preceding claim, wherein the solenoid valve is configured to move from the closed position to the open position when the solenoid is energized.

Aspect 15: The device of any preceding claim, wherein the solenoid is configured to move from the open position to the closed position when the solenoid is not energized.

Aspect 16: The device of any preceding claim, wherein the valve is configured to move from the open position to the closed position when the solenoid is not energized.

Aspect 17: The device of any preceding claim, wherein the solenoid is configured to move the valve from the open position to the closed position when the solenoid is energized.

Aspect 18: The device of any preceding claim, wherein the valve is configured to move from the open position to the closed position when the solenoid is energized.

Aspect 19: The device of any preceding claim, a power source for powering one or more device components.

Aspect 20: The device of any preceding claim, wherein the faucet adapter is configured to be releasably attached to an end of a faucet or spigot.

Aspect 21: The device of any preceding claim, wherein the faucet adapter comprises a first or "on" position configured to direct liquid flowing therethrough along a controlled liquid flow path, and a second or "bypass" position configured to direct liquid flowing therethrough along a bypass liquid flow path.

Aspect 22: The device of any preceding claim, wherein the first or "on" position is configured to direct liquid flowing through the adapter along a controlled liquid flow path, and a second or "bypass" position configured to direct liquid flowing through the adapter along a bypass liquid flow path.

Aspect 23: The device of any preceding claim, wherein the first temperature data comprises temperature data associated with an environment or air outside of a dwelling to which the device is connected.

Aspect 24: The device of any preceding claim, wherein the second temperature data comprises temperature data associated with an environment or air adjacent to the device.

Aspect 25: The device of any preceding claim, wherein the air adjacent to the device comprises air that is in thermal communication with at least a portion of the device or device housing.

Aspect 26: The device of any preceding claim, wherein the air adjacent to the device comprises air in an environment to which least a portion of the device or device housing is connected.

Aspect 27: The device of any preceding claim, wherein the air adjacent to the device comprises at least one of: air inside of a dwelling to which the device is connected and air outside of the dwelling to which the device is connected.

Aspect 28: The device of any preceding claim, wherein the air adjacent to the device is air inside the dwelling.

Aspect 29: The device of any preceding claim, wherein the air adjacent to the device is air outside of the dwelling.

Aspect 30: The device of any preceding claim, wherein the controller is configured to utilize the temperature data to control the valve position upon meeting predetermined criteria.

Aspect 31: The device of any preceding claim, wherein the controller is configured to control the solenoid or actuator.

Aspect 32: The device of any preceding claim, wherein the solenoid valve comprises at least one of a piloted solenoid valve and a direct acting solenoid valve.

Aspect 33: The device of any preceding claim, further comprising a low power or low battery indicator.

Aspect 34: The device of any preceding claim, wherein the low power or low battery indicator comprises a light emitting diode (LED) or a visible light component, or the like.

Aspect 35: The device of any preceding claim, wherein the low power or low battery indicator is configured to provide feedback to the user so the user knows that the product is operational.

Aspect 36: The device of any preceding claim, further comprising a test button configured to allow the user to test at least one functionality or operation of the device.

Aspect 37: The device of any preceding claim, wherein when a first predetermined criteria are met, the controller is configured to cause the valve to be in the closed position, thereby preventing water or liquid from flowing from the supply pipe through the inlet or a valve opening.

Aspect 38: The device of any preceding claim, wherein when a second predetermined criteria is met, the controller is configured to cause the valve to be in the open position, thereby allowing water or liquid from the supply pipe to flow through the inlet or valve opening.

Aspect 39: The device of any preceding claim, wherein the controller is configured to receive temperature data from at least one temperature sensor or remote temperature sensor, and further configured to determine the valve position based on received temperature data.

Aspect 40: The device of any preceding claim, wherein the controller is configured to cause the valve position to be in the closed position when the temperature data received from the temperature sensor is above a predetermined threshold.

Aspect 41: The device of any preceding claim, wherein the controller is configured to cause the valve position to be in the open position when the temperature data received from the temperature sensor is below a predetermined threshold.

Aspect 42: The device of any preceding claim, further comprising a plurality of temperature sensors.

Aspect 43: The device of any preceding claim, wherein the temperature sensor is further configured to determine temperature data of the water or liquid flowing through the inlet or valve opening.

Aspect 44: The device of any preceding claim, wherein the temperature sensor comprises an external temperature sensor, remote temperature sensor, wireless temperature sensor, or a combination thereof.

Aspect 45: The device of any preceding claim, wherein the external temperature sensor is connected to the device by a wire.

Aspect 46: The device of any preceding claim, wherein the first predetermined criteria comprises temperature data above a predetermined threshold.

Aspect 47: The device of any preceding claim, wherein the first predetermined criteria comprises air temperature data above a predetermined threshold.

Aspect 48: The device of any preceding claim, wherein the first predetermined criteria comprises water temperature data above a predetermined threshold.

Aspect 49: The device of any preceding claim, wherein the second predetermined criteria comprises temperature data below a predetermined threshold.

Aspect 50: The device of any preceding claim, wherein the second predetermined criteria comprises air temperature data below a predetermined threshold.

Aspect 51: The device of any preceding claim, wherein the second predetermined criteria comprises water temperature data below a predetermined threshold.

Aspect 52: The device of any preceding claim, further comprising a flow meter configured to measure a flow rate of the water or liquid through the inlet or valve opening.

Aspect 53: The device of any preceding claim, wherein the controller is configured to change the valve position by controlling electrical power to the actuator or solenoid from the power source.

Aspect 54: The device of any preceding claim, wherein the controller is configured to move the valve position to the open position by delivering electrical power from the power source to the actuator or solenoid when temperature data received from the temperature sensors is below a predetermined threshold.

Aspect 55: The device of any preceding claim, wherein the controller is configured to move the valve position to the closed position from the open position by disconnecting electrical power to the solenoid when the temperature data received from the temperature sensor is above a predetermined threshold.

Aspect 56: The device of any preceding claim, wherein the controller is configured to move the valve position to the closed position from the open position by actuating the actuator to cause the valve position change when the temperature data received from the temperature sensor is above a predetermined threshold.

Aspect 57: The device of any preceding claim, wherein the predetermined threshold is a predetermined temperature.

Aspect 58: The device of any preceding claim, wherein the predetermined temperature is the temperature of the air or water is at or near the freezing temperature of water. (32° F.)

Aspect 59: The device of any preceding claim, wherein the flow control component comprises a pressure compensating or pressure regulating dripper.

Aspect 60: The device of any preceding claim, wherein the flow control component is a flow control orifice.

Aspect 61: The device of any preceding claim, wherein the flow control component is configured to allow adjustment of the drip rate.

Aspect 62: The device of any preceding claim, wherein the power source comprises a battery, DC power supply, A/C power, solar power, or a combination thereof.

Aspect 63: The device of any preceding claim, wherein the device is configured to be threadably attach to at least one of: a spigot, spout, and faucet.

Aspect 64: The device of any preceding claim, wherein the device is configured to attach by screwing the device directly onto at least one of: a spigot, spout, and faucet.

Aspect 65: The device of any preceding claim, further comprising a display unit configured to show information related to device status, settings, parameters, or performance.

Aspect 66: The device of any preceding claim, wherein the display unit is further configured to generate a user interface (UI), wherein the UI is configured to enable a user of the flow control device to perform management of the flow control device.

Aspect 67: The device of any preceding claim, further comprising a communication unit configured to communicate with a client device or remote monitoring device.

Aspect 68: The device of any preceding claim, wherein the controller is further configured to generate a Graphical User Interface (GUI) presentable on a client device, wherein the GUI is configured to enable a user of the client device to perform management of the flow control device.

Aspect 69: The device of any preceding claim, wherein the device is waterproof.

Aspect 70: The device of any preceding claim, wherein the device components are in an integral assembly.

Aspect 71: The device of any preceding claim, wherein the device components are all housed within the housing such that device components are unexposed.

While aspects of the presently disclosed subject matter can be described and claimed in a particular statutory class, such as the system statutory class, this is for convenience only and one of skill in the art will understand that each aspect of the presently disclosed subject matter can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way appreciably intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications are referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the presently disclosed subject matter is not entitled to antedate such publication by virtue of prior invention. Further, the dates of publication provided herein can be different from the actual publication dates, which can require independent confirmation.

The patentable scope of the presently disclosed subject matter is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. Although very narrow claims are presented herein, it should be recognized the scope of this disclosure is much broader than presented by the claims. It is intended that broader claims will be submitted in an application that claims the benefit of priority from this application.

Those skilled in the art to which this presently disclosed subject matter pertains will readily appreciate that numerous changes, variations, and modifications can be made without departing from the scope of the presently disclosed subject matter, mutatis mutandis.

The invention claimed is:

1. A system for preventing freeze-induced rupture of one or more supply pipes, the system comprising:

at least one remote temperature sensor configured to determine first temperature data associated with air outside of a building;

at least one internal temperature sensor configured to determine second temperature data associated with air adjacent to the flow control device; and a flow control device configured attach to the one or more supply pipes, the flow control device comprising:

an inlet disposed at an upstream end of the flow control device and configured to be connected to at least one of the one or more supply pipes;

an outlet disposed at a downstream end of the flow control device and configured to be connected to a drainage pipe;

at least one valve disposed between the inlet and the outlet, and being configured to be electronically controlled to selectively move between a closed position in which liquid is blocked from flowing therethrough, and an open position in which flow of liquid is permitted therethrough; and at least one flow control component disposed between the inlet and the outlet, and being configured to limit the flow rate of liquid therethrough;

the system further comprising a controller communicatively connected to the at least one remote temperature sensor and the at least one internal temperature sensor, and being configured to control operation of the at least one valve based at least on one of the first temperature data or the second temperature data.

2. The system according to claim 1, wherein the at least one valve is disposed upstream of the at least one flow control component.

3. The system according to claim 1, the flow control device comprising two inlets, each configured to be connected to at least one of the supply pipes.

4. The system according to claim 3, the flow control device comprising two of the valves, each being disposed downstream of one of the inlets.

5. The system according to claim 4, the flow control device comprising a separate flow control component associated with each of the valves.

6. The system according to claim 4, the flow control device comprising a single flow control component associated with all of the valves.

7. The system according to claim 4, wherein the controller is configured to operate the valves such that no more than one is in its open position simultaneously.

8. The system according to claim 1, wherein the controller is configured to direct at least one of the valves to assume its respective open position the when at least first temperature data or the second temperature data is below a predetermined threshold.

9. The system according to claim 1, wherein the controller is configured to direct at least one of the valves to assume its respective closed position the when at least first temperature data or the second temperature data is above a predetermined threshold.

10. The system according to claim 1, further comprising one or more flow sensors, the controller being further configured to determine one or more fault conditions based at least on data provided by the one or more flow sensors.

* * * * *